US005803782A

United States Patent [19]

Selton

[11] Patent Number: 5,803,782

[45] Date of Patent: Sep. 8, 1998

[54] UNIVERSAL CONNECTOR

[76] Inventor: Daniel E. Selton, 5350 Powers Ferry Rd., Atlanta, Ga. 30327

[21] Appl. No.: 703,972

[22] Filed: Aug. 28, 1996

[51] Int. Cl.[6] ..... A63H 33/08

[52] U.S. Cl. ..... 446/126; 446/125

[58] Field of Search ..... 446/85, 107, 108, 446/111–115, 122–127

[56] References Cited

U.S. PATENT DOCUMENTS

| | | | |
|---|---|---|---|
| Re. 33,785 | 12/1991 | Hildenbrandt et al. | 446/126 |
| D. 222,323 | 10/1971 | Defee | D1/99 |
| 669,029 | 2/1901 | Faller | 446/122 |
| 1,113,371 | 8/1914 | Pajeau . | |
| 1,124,526 | 1/1915 | Richter . | |
| 1,155,035 | 9/1915 | Bostwich . | |
| 1,193,975 | 8/1916 | Beardsley | 446/109 |
| 1,242,273 | 10/1917 | Thurman . | |
| 1,281,832 | 10/1918 | Post | 446/112 |
| 1,281,856 | 10/1918 | Shaw | 446/112 |
| 1,288,226 | 12/1918 | Schrader | 446/126 |
| 1,400,066 | 12/1921 | Huck . | |
| 1,426,087 | 8/1922 | Metcalfe | 446/112 |
| 1,929,906 | 6/1933 | Skokowski . | |
| 2,149,476 | 9/1939 | Tetzlaff . | |
| 3,153,299 | 10/1964 | Jennings . | |
| 3,386,590 | 6/1968 | Gretz | 211/177 |
| 3,498,808 | 3/1970 | Wagner . | |
| 3,663,717 | 5/1972 | Coster . | |
| 3,685,465 | 8/1972 | Haumer | 108/111 |
| 3,747,261 | 7/1973 | Salem . | |
| 3,748,778 | 7/1973 | Ellies et al. . | |
| 3,890,738 | 6/1975 | Bassani | 446/111 |
| 3,973,855 | 8/1976 | Florence | 403/171 |
| 4,084,344 | 4/1978 | Asano . | |
| 4,143,481 | 3/1979 | Loechel . | |
| 4,348,129 | 9/1982 | Conforti | 403/218 |
| 4,493,425 | 1/1985 | Yoshida | 211/189 |
| 4,566,246 | 1/1986 | Sanger | 446/126 |
| 4,673,308 | 6/1987 | Reilly | 403/172 |
| 5,121,526 | 6/1992 | Burkdard et al. | 24/336 |
| 5,282,767 | 2/1994 | Gelardi | 446/126 |
| 5,469,681 | 11/1995 | Wu | 52/656.9 |
| 5,518,435 | 5/1996 | Glickman | 446/126 |
| 5,527,201 | 6/1996 | Maddock | 446/104 |
| 5,549,408 | 8/1996 | Lo | 446/126 |

FOREIGN PATENT DOCUMENTS

| | | | |
|---|---|---|---|
| 735648 | 6/1966 | Canada | 446/122 |
| 498 368 A2 | of 1992 | European Pat. Off. . | |
| 886861 | of 1943 | France . | |
| 1145586 | of 1957 | France . | |

*Primary Examiner*—Robert A. Hafer
*Assistant Examiner*—Jeffrey D. Carlson
*Attorney, Agent, or Firm*—Troutman Sanders LLP; Gerald R. Boss

[57] ABSTRACT

A plurality of connector blocks and connecting members are provided to comprise a universal connector assembly. In this assembly, each connector block is formed to have a body portion defining a plurality of sides that extend outwardly from a central region. Each side is substantially cross-shaped and has a substantially cross-shaped receiving slot. A plurality of elongated connecting members are also provided for releasable engagement within the receiving slots of the connector units. Like the receiving slots, the connecting members have a substantially cross-shaped cross-section and are appropriately dimensioned to releasably engage the receiving slots of the connector units.

4 Claims, 3 Drawing Sheets

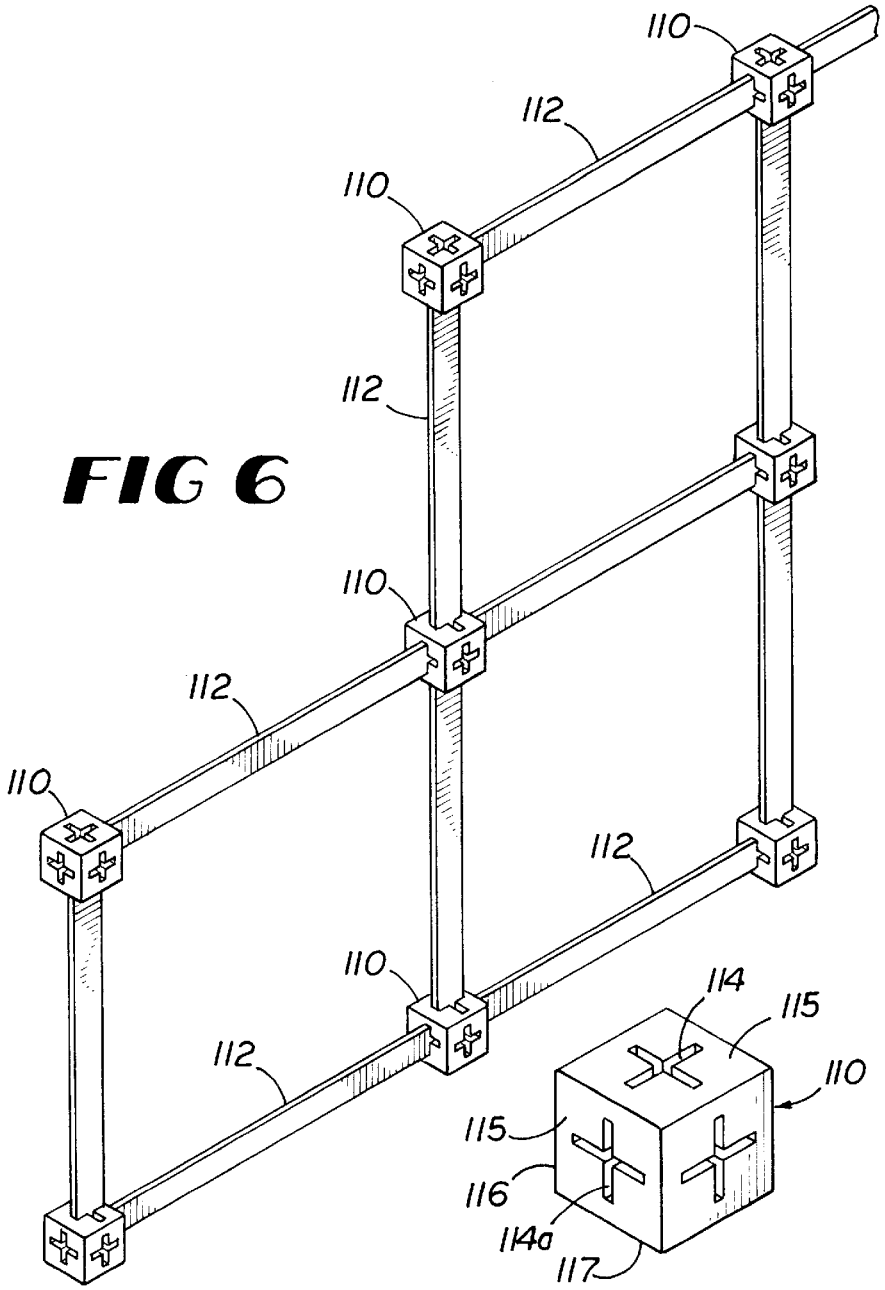
FIG 6
FIG 7A
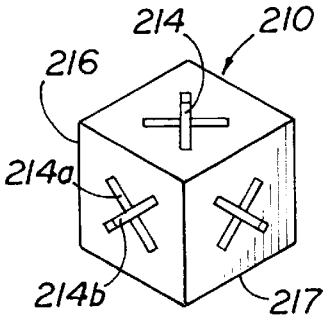
FIG 7B
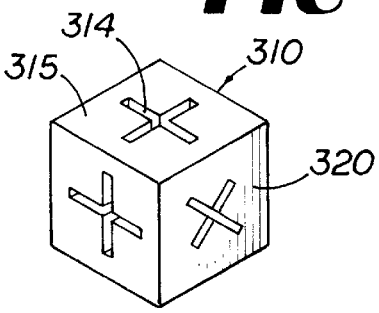
FIG 7C
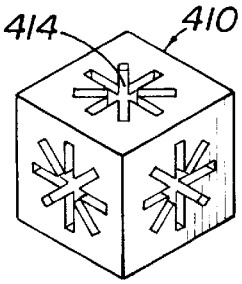
FIG 7D

UNIVERSAL CONNECTOR

FIELD OF THE INVENTION

The present invention generally relates to connector assemblies, and more particularly to a universal connector readily adapted for a variety of applications including small-scale toys, as well as industrial-scale construction assemblies.

DISCUSSION OF THE RELATED ART

A wide variety of children's constructor sets have long been known having a number of interlocking pieces which may be variably and creatively engaged or otherwise interlocked to form assemblies of a variety of shapes and sizes. For example, U.S. Pat. No. 3,663,717 discloses a connector set that utilizes uniquely shaped interlocking sticks. Specifically, and as disclosed in the '717 patent, the sticks are preferably of a type frequently used as holding sticks of frozen confections such as ice cream, flavored ice, and the like. In this regard, the '717 patent contemplates the reuse of such sticks for a child's toy.

U.S. Pat. No. 1,400,066 shows a construction toy set comprising a plurality of cylindrically-shaped rods interconnected by connector blocks. In one form, the connector blocks are illustrated as cube-shaped, with each cube side having a centrally-located cylindrical bore to receive an end of a cylindrical rod. In alternative embodiments, differently shaped connector blocks are also taught. Similarly, U.S. Pat. No. 3,153,299 illustrates an apparatus for making models or structures having connector blocks defining I-shaped receiving slots for receiving the ends of similarly shaped I-beams.

Based upon the foregoing and other prior art, it can be appreciated that a wide variety of connector assemblies, for a wide variety of applications, are known. However, there are various shortcomings in the prior art. For example, cube-shaped connector blocks such as those in the '066 patent may be unduly or undesirably heavy in relation to the connecting rods. For example, in the case of a child's toy, like that illustrated in the '717 patent, cube-shaped connector blocks may be unduly heavy in relation to lighterweight connecting members that interconnect the blocks. As a result of the relative weight imbalance, the construction set performance or desirability may be compromised.

Other shortcomings relate to versatility. For example, the shape of the I-beam connecting members of the '299 patent diminishes the versatility of the connector. As will be described more fully in the detailed description of this application in connection with the present invention, if the connector is being utilized to build a structure wherein panel sheet members are interconnected between the connecting members, the I-shape is not readily conducive to such attachment.

SUMMARY OF THE INVENTION

Accordingly, a primary object of the present invention is to provide a universal connector.

Another object of the present invention is to provide a uniquely shaped connector for readily supporting a variety of applications.

A related object of the present invention is to provide a connector having a plurality of faces, each adapted to receive a connector member in a plurality of orientations.

Another object of the present invention is to provide an improved construction toy set.

Another object of the present invention is to provide an improved moveable building structure.

A related object of the present invention is to provide a connector providing a most desirable shape for weight and volume to structural strength.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to a universal fastening assembly. In accordance with one aspect of the invention, a plurality of connector units are provided, wherein each connector unit includes a body portion defining a plurality of sides that extend outwardly from a central region. In this configuration, each side is substantially cross-shaped and has a substantially cross-shaped receiving slot. A plurality of elongated connecting members are also provided for releasable engagement within the receiving slots of the connector units. Like the receiving slots, the connecting members have a substantially cross-shaped cross-section and are appropriately dimensioned to releasably engage the receiving slots of the connector units.

In accordance with another aspect of the present invention a cube-shaped connector for a construction toy set is provided. Each cube-shaped connector comprises a plurality of substantially planar faces, each face defining a plurality of linear receiving slots for receiving an end of at least one substantially planar connector stick in alternative orientations.

In accordance with one aspect this embodiment, the receiving slots are intersectably disposed in substantially perpendicular fashion, wherein the intersection point is near the center of each linear receiving slot. In this way, an end of an elongated, substantially planar connector stick may be inserted into only one of the receiving slots at any given time. In the preferred embodiment, the connector cube is injection molded and uniquely shaped to provide an extremely lightweight connector. In this embodiment, six elongated cross-shaped sides are symmetrically disposed to project from a central region. The molded plastic is closely contoured about the intersecting receiving slots on all six sides.

DESCRIPTION OF THE DRAWINGS

The accompanying drawings incorporated in and forming a part of the specification, illustrate several aspects of the present invention, and together with the description serve to explain the principles of the invention. In the drawings:

FIG. 6 is a perspective view of a plurality of interconnected connector blocks and sticks in accordance with an alternative embodiment of the present invention;

FIG. 7A is a perspective view of a cube-shaped connector block constructed in accordance with the alternative embodiment of FIG. 6;

FIG. 7B is a perspective view of a cube-shaped connector block similar to that of FIG. 6, having an alternative receiving slot configuration;

FIG. 7C is a perspective view of a cube-shaped connector block similar to that of FIG. 6, having an alternative receiving slot configuration; and FIG. 7D is a perspective view of a cube-shaped connector block similar to that of FIG. 6, having an alternative receiving slot configuration.

Figure 1:
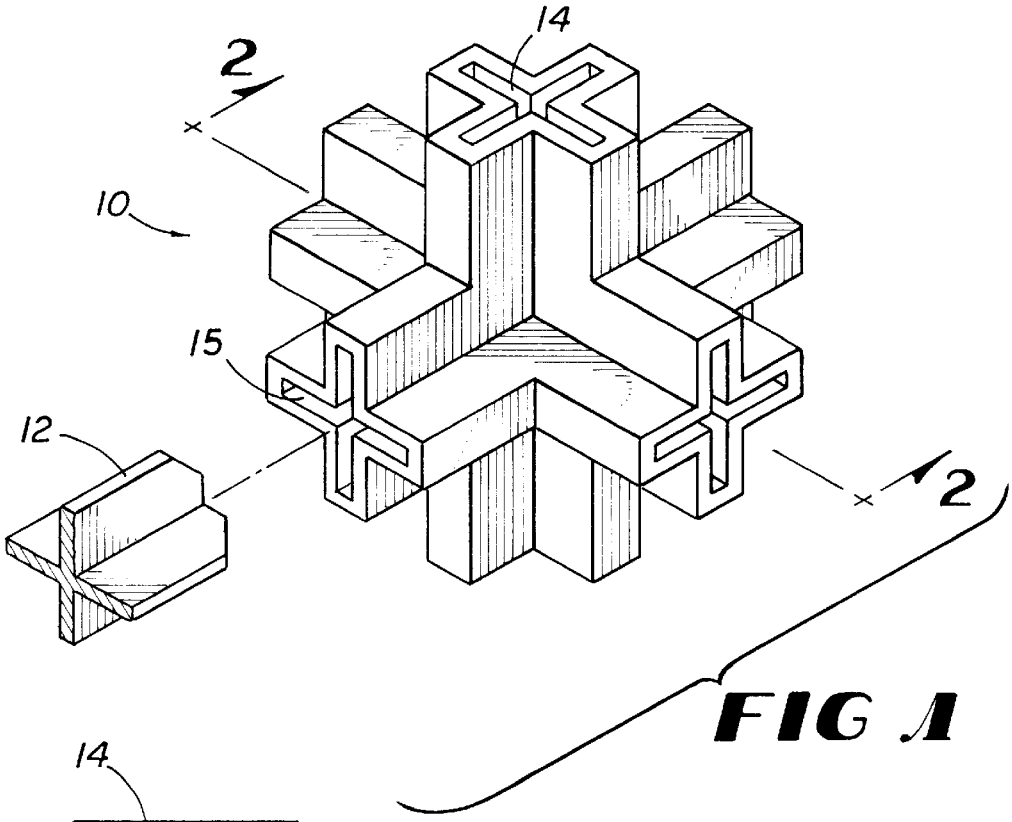
FIG. 1 is a perspective view of a universal connector block constructed in accordance with the invention.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE PREFERRED EMBODIMENT

Figure 2:
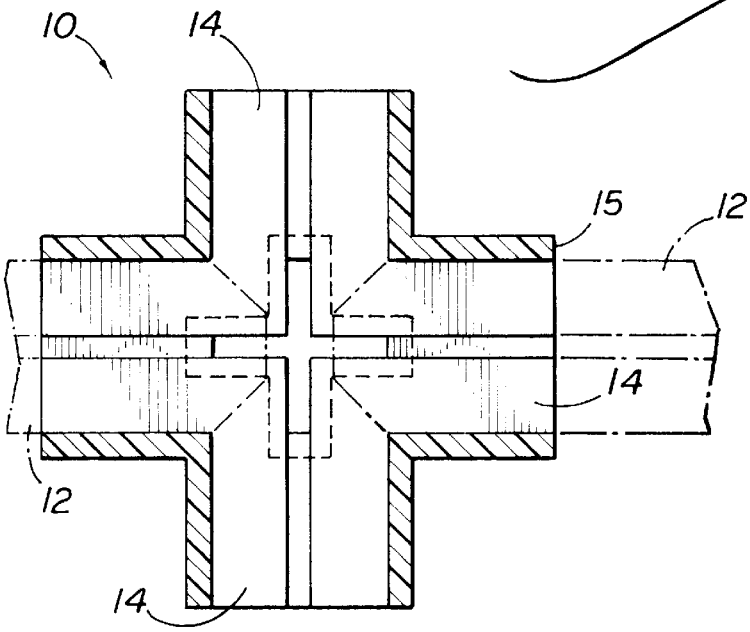
FIG. 2 is a cross-sectional view of the connector block as taken substantially along line 2—2 of FIG. 1.
Figure 3:
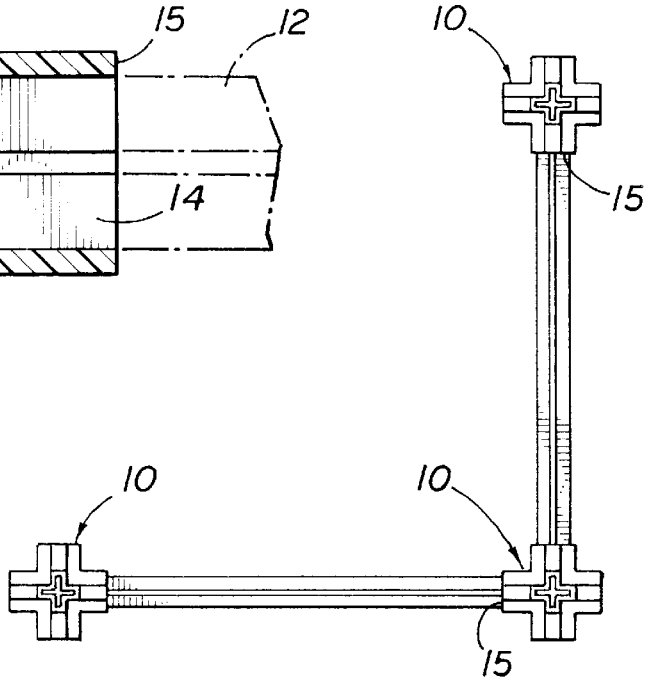
FIG. 3 is a side view of a plurality of interconnected connector blocks and sticks in accordance with the invention.

Turning now to the drawings, FIG. 1 is a perspective view of universal connector, constructed in accordance with the present invention, and generally designated by reference numeral 10. As will be described below, the unique shape of the connector 10 desirably makes the connector both lightweight and cost-efficient. FIGS. 2 and 3 are also referenced in connection with this preferred embodiment. In this regard, FIG. 2 is a cross-sectional side view as taken substantially along line 2—2 of FIG. 1. FIG. 3 illustrates the interconnection of a plurality of connector blocks 10 with cross-shaped connector sticks 12.

In the preferred embodiment, the connector 10 has a body portion that defines six symmetrically-disposed sides 15 that project outwardly from a central region. Each side 15 is preferably cross-shaped and includes a cross-shaped receiving slot 14 for receiving a connector stick 12. Similarly, connector sticks 12 are used to interconnect the connector blocks 10 to create a variety of structures. A cross-shaped connector stick 12 is illustrated in FIG. 1 exploded from a corresponding receiving slot 14.

Preferably, the cross-shaped connector stick 12 is tapered 13 at each end to facilitate its insertion into the connector block. Nevertheless, it should be appreciated that the taper is not necessary to achieve the objects and advantages of the present invention. Also in the preferred embodiment, the cross-shaped connector stick 12 will be symmetric, with sides of equal dimension. Advantageously, this eases the assembly process, since the connector stick 12 will be received by the conector slots 14 in any orientation. All that is required is that the cross-shape line up with the receiving slot 14 for insertion.

Rather than being cross-shaped, the connector stick in an alternative embodiment may be planar. For example, in one embodiment a plurality of connectors 10 is utilized along with a plurality of popsicle sticks to comprise a low-cost construction set for children. The cross-shaped receiving slots 14 allow insertion of a planar connector stick in one of two orthogonally-disposed orientations.

A similar objective is achieved by injection molding a plurality of connectors 10 and a plurality of cross-shaped connector sticks 12 to comprise a toy construction set. It will be appreciated that the unique shape of the connector 10 provides a favorably lightweight and cost-effective connector 10. To more particularly describe, FIG. 7A illustrates an alternative embodiment having cube-shaped connectors. It is observed that substantially more material (volumetrically) goes into such a cube-shaped connector, than goes into a connector 10, such as that illustrated in FIG. 1. Therefore, the resulting connector 10 is relatively lightweight and less expensive to manufacture.

Indeed, the connector sticks 12 are a relatively low-cost item which may be provided in a variety of sizes, materials, or colors. As mentioned, in one embodiment it is contemplated that ordinary popsicle sticks will be utilized for connector sticks 12. Alternatively, larger instruments such as tongue depressors or the like may be utilized as well. In yet another embodiment, injection-molded plastic slats or cross-shaped connector sticks may be manufactured. Whether the sticks 12 comprise injection-molded plastic, wood, steel bars, or some other materials, they may be provided in a variety of lengths and widths, as well as colors, to furnish a more complete and versatile construction set. In the same way, the connector blocks 10 may be manufactured in a variety of sizes to be mixed and matched with appropriately sized connector sticks 12.

As previously mentioned, the connector sticks 12 are dimensioned to releasably engage the receiving slots 14. In the preferred embodiment, this releasable engagement will be achieved by a press-fit configuration. Therefore, the receiving slots 14 will be properly sized to snugly receive the connector stick 12, whether that is a popsicle stick, tongue depressor, or other instrument, including specially manufactured or molded connector sticks 12. Preferably, the connector blocks 10 are formed from injection-molded plastic. The material used in the injection-molding process may be tailored to form a reasonably pliable or resilient cube structure, whereby the resilience serves to provide a gripping action to facilitate the engagement between the receiving slots 14 and the connector stick 12. Alternatively, the plastic material may be tailored to form a more rigid connector block 10, whereby the engagement between the receiving slots 14 and a connector stick 12 is properly provided by more precisely controlling the dimensions of the receiving slots 14. In another embodiment, the connector sides may have holes (not shown) that align with holes of the connector stick 12, allowing the sticks 12 to be pinned or bolted to the connector block 10. Further still, the inner surfaces of the receiving slots 14 may be dimpled or otherwise textured to enhance engagement between the receiving slots 14 and connector stick 12. Regardless of the particular method or manner in which the engagement is created, it will be appreciated that the engagement will not be excessively tight.

Mindful that the one embodiment of the present invention is directed to a construction toy set, which will be used by children, creating a connector block 10/connector stick 12 engagement in that embodiment that is excessively tight will not only frustrate many children, but will also result in increased incidents of destruction by breaking the ends of connector sticks 12 within receiving slots 14.

Figure 4A:
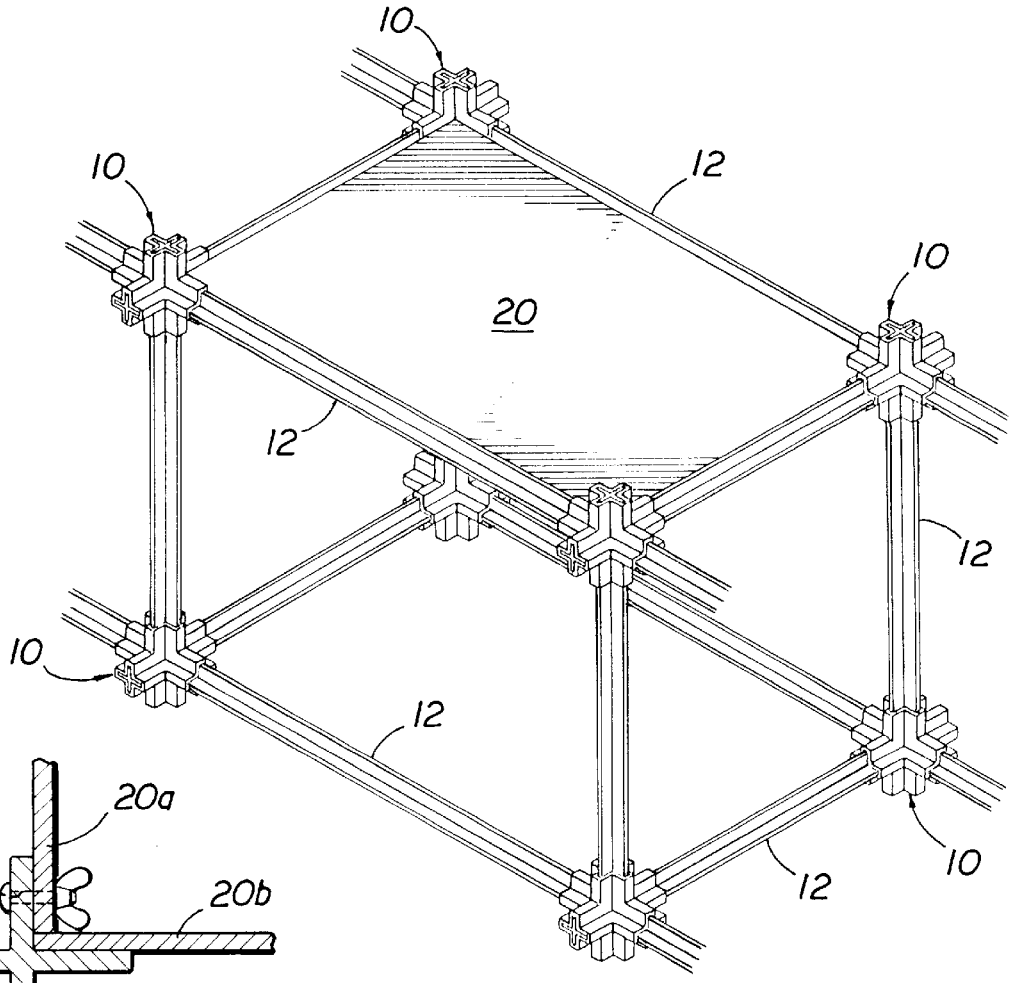
FIG. 4A is a side view illustrating the use of the present invention in the construction of a display rack.

In addition to a toy construction set, the universal connector 10 is also readily adapted to a variety of other uses as well. In this regard, reference is made to FIGS. 4A, 4B, and 5. FIG. 4A illustrates the use of a connector 10 shaped like that of FIG. 1 in the construction of a display rack, for example. Frequently, display racks or other similar platforms must not only be versatile, but also readily adapted for disassembly for transport. The simple, but effective design of the preferred connector 10 uniquely suits it for this purpose. The press-fit engagement of the connector sticks 12 allow ready assembly and disassembly of such a construct. Moreover, the cross-shaped connector sticks 12 uniquely enable them to support attached sheeting material, such as paneling or shelving.

In this regard, FIG. 4A illustrates a set of connectors 10 and connector sticks 12 that have been assembled to construct a display rack. To complete the assembly, a horizontally disposed shelf panel 20 overlies the ledge formed by the cross-shaped connector stick 12. To more particular describe this engagement, reference is made to FIG. 4B, which is a cross-sectional end view illustrating different ways in which sheeting material may engage or attach to a connecting stick 12.

Figure 4B:
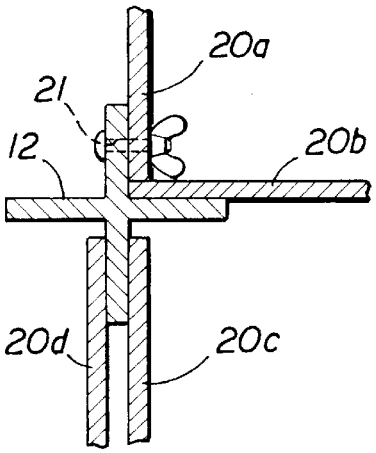
FIG. 4B is a cross-sectional end view of a connecting member illustrating the attachment of panel members thereto for a particular application of the present invention.

Specifically, FIG. 4B depicts four different sheeting panels 20*a*, 20*b*, 20*c*, and 20*d* in connection with a single connector stick 12. As illustrated, a single connector stick 12 may support a plurality of interconnected sheeting panels. As illustrated in FIG. 4A, a sheeting panel 20 may be retained in place merely by the engagement resulting from the force gravity. Alternatively, pilot holes (not shown) may be provided in both the ledges of the connector sticks 12 and at the edges of the sheeting panels. Bolts, connector pins, rivets, or other connecting devices may be inserted through aligned pilot holes to maintain the attachment between the sheeting panel 20 and the connector stick 12. Furthermore, two sheeting panels 20*c* and 20*d* may share a single ledge from the connector stick 12, if desired.

It will be appreciated that the size of the connector block 10, as well as the material will depend upon the particular application. For example, for a relatively heavy-duty shelving application the connector may be cast from aluminum, while the connector will preferably be injection molded in lightweight toy applications. Also in regard to the toy application, similar lightweight sheeting panels may be included. Small elongated ridges (not shown) may be provided along the connector sticks 12 to allow properly sized panels to snap into engagement between the connector sticks 12.

Figure 5A:
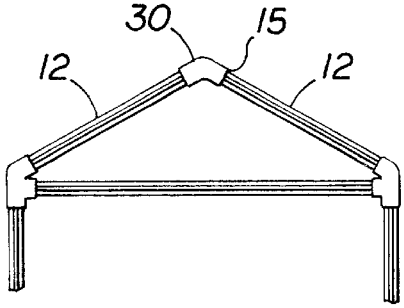
FIGS. 5A and 5B is a side view illustrating the use of the present invention in the construction of a roof section of a building structure.
Figure 5B:
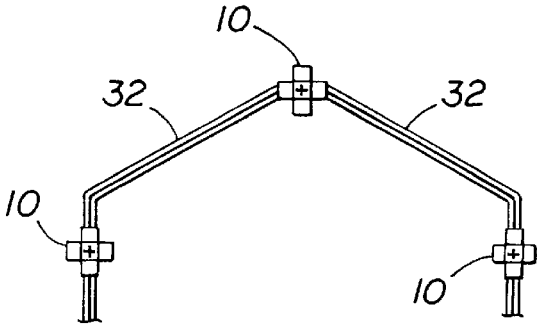

Yet another application for the connector block 10/connector stick 12 is illustrated in FIGS. 5A and 5B. In this application, connectors 10 and connector sticks 12 may by utilized to construct transportable living quarters, such as army barracks. In this application, the connector blocks 10, connector sticks 12, and sheeting panels 20 disassemble into readily transportable component parts. It will be appreciated that if a relatively heavy-gauge aluminum or covered plywood, for example, may be used for the sheeting panels 20, barracks may be provided having much greater durability than provided by more traditional tent structures. This enhanced durability translates into improved safety, as heavy-gauge aluminum (or like material) would readily withstand gun fire.

Consistent with this application, is should be pointed out that variants on the shape of the connector blocks 10 and connector sticks 12 may be provided. For example, FIGS. 5A and 5B illustrate the use of the present invention to construct a triangular-shaped roof structure. In one embodiment (FIG. 5A), the sides 15 of the connector blocks 30 may be angularly disposed to accommodate such a triangular shape (when assembled). Alternatively, uniquely shaped connector sticks 32 (FIG. 5B) may be so provided.

Indeed, it will be appreciated that connector blocks and connector sticks constructed in accordance with the present invention may be readily adapted for a wide variety of applications and uses.

In addition to the uniquely shaped connector 10 depicted in FIGS. 1–5, alternative shapes may be provided. As illustrated in the alternative embodiment of FIG. 6, a construction set may include a plurality of cube-shaped connector blocks 110 as well as a plurality of elongated, and substantially planar connector sticks 112. In this embodiment, the connector blocks 110 are cube-shaped defining six substantially planar faces. On each face, slots 114 are provided to receive an end of a connector stick 112 in a releasably engaging fashion.

In keeping with this embodiment of the invention, FIGS. 7A–7D illustrate alternative embodiments of the present invention. As previously mentioned, it is one aspect of the invention to provide substantially linear receiving slots 114 in the faces 115 of the connector block 110 to receive an end of a elongated, but substantially planar connector stick 112 in alternative orientations. The embodiment illustrated in FIG. 7A depicts receiving slots 114 that are perpendicularly disposed in orthogonal and parallel relation to the edges of the cube-shaped connector block 110. For example, receiving slot 114*a* is disposed substantially parallel to the vertical (as illustrated) edges 116 of the face 115, and substantially orthogonal or perpendicular to the horizontally disposed edges 117 of face 115. Moreover, the receiving slots 114 of the connector block 110 illustrated in FIG. 7A are uniformly disposed on each face 115 of the connector block. That is, the receiving slots 114 are identically disposed on each face.

Referring briefly to FIG. 7B, an alternative embodiment of a connector block 210 is illustrated. In this embodiment, receiving slots 214, like receiving slots 114 of FIG. 7A are disposed in substantially orthogonal relation to each other (e.g. 214*a* and 214*b*). However, unlike the receiving slots 114 of FIG. 7A, the receiving slots 214 are disposed in diagonal fashion in relation to the face 215 of connector block 210. That is, the receiving slots 214*a* and 214*b* are disposed in oblique relation to the sides 216 and 217 of cube 210, as opposed to being substantially parallel or substantially orthogonal thereto. Like the connector block 110 and FIG. 7A, the receiving slots 214 of connector block 210 are uniformly disposed on each face 215.

Referring briefly to FIG. 7C, a further embodiment of the present invention is shown. In this embodiment is something of a hybrid of the embodiments shown in FIG. 7A and FIG. 7B. More specifically, like FIGS. 7A and 7B, the receiving slots 314 are disposed in orthogonal relationship to each other, but unlike FIGS. 7A and 7B, the receiving slots 314 are not uniformly disposed on each face of the connector block 310. In this regard, the receiving slots 314 on face 315 are oriented like receiving slots 114 of FIG. 7A while receiving slots 314 on face 320 are oriented like receiving slots 214 of FIG. 7B. The receiving slots 314 on the remaining face of the connector cube 310 are preferably disposed in either the orientation of face 315, face 320, or an intermediate orientation.

FIG. 7D shows yet another embodiment of a connector block 410 constructed in accordance with the present invention. In this embodiment, four intersectably disposed receiving slots 414 are provided. As illustrated, the slots 414 substantially bisect one another to form a star-like configuration. As will be appreciated, the configuration of FIG. 7D allow the receiving slots to receive a corresponding connector stick 412 in one of four orientations, at any given time. Although not shown, it will be appreciated that a further embodiment may be provided having receiving slots that hybrid of that shown in FIG. 7D and that shown FIG. 7C. That is, some faces of the connector block may have four intersectably disposed receiving slots 414, while other faces may have two, three or some other number of receiving slots.

Again, it should be appreciated from the discussion of the various embodiments illustrated in above-described drawings that connector blocks may be mixed and matched to provide a versatile and entertaining construction set. However, the foregoing description has been presented for purposes of illustration and description only, and it is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A universal fastening assembly comprising:

a plurality of connector units, each connector unit having a body defining at least six sides that extend outwardly from a central region, each side being substantially cross-shaped and having a hollow interior for defining a substantially cross-shaped receiving slot;

a plurality of elongated connecting members, the connecting members having a substantially cross-shaped cross-section and being dimensioned for being releasably received by said receiving slots of the connector units so that an end portion of each respective connecting member is fully enclosed and evenly supported around its periphery by a respective side;

said end portion of a respective cross-shaped connecting member terminating in a single plane; and whereby each respective connecting member is independently and solely supported by each respective side of each connector unit.

2. The fastening assembly as defined in claim 1, further including an attachment means for securing the engagement between a connecting member and a connector unit.

3. The fastening assembly as defined in claim 2, wherein the attachment means further includes a hole in each side of the body of the connector unit.

4. The fastening assembly as defined in claim 3, wherein the attachment means further includes a corresponding hole in the ends of the connecting member to align with the hole in each side of the body of the connector unit, wherein the aligned holes receive a latching member carried by a respective connecting member that secures the connecting member to the body portion.

* * * * *